United States Patent [19]

Norman

[11] 4,374,439

[45] Feb. 22, 1983

[54] WRIST SUPPORT WITH PALM PAD

[76] Inventor: Bill Norman, 14431 Galy, Tustin, Calif. 92680

[21] Appl. No.: 222,655

[22] Filed: Jan. 5, 1981

[51] Int. Cl.[3] ..... A41D 19/00

[52] U.S. Cl. ..... 2/161 A; 2/20; 273/54 B

[58] Field of Search ..... 2/161 A, 161 R, 159, 2/16, 20; 273/54 B

[56] References Cited

U.S. PATENT DOCUMENTS

| | | | |
|---|---|---|---|
| 3,031,680 | 5/1962 | Compiano | 273/54 B X |
| 3,421,160 | 1/1969 | Domenico | 273/54 B X |
| 3,583,704 | 6/1971 | Callanan | 273/54 B |
| 3,598,408 | 8/1971 | Klose | 273/54 B |
| 3,606,319 | 9/1971 | Borden | 273/54 B |
| 3,704,994 | 12/1972 | Krzewinski | 273/54 B |
| 3,728,738 | 4/1973 | Andolino | 273/54 B X |
| 3,790,168 | 2/1974 | Hashimoto | 273/54 B |

*Primary Examiner*—Richard J. Scanlan, Jr.

*Attorney, Agent, or Firm*—Gausewitz, Carr, Rothenberg & Edwards

[57] ABSTRACT

This invention provides a bowler's wrist support that includes a flexible body adapted to be wrapped around the hand and wrist with straps to hold it in position. A rigid reinforcement may be included to prevent bending of the wrist. The body includes a pocket within which fits a pad which is positioned at the palm of the hand when the device is worn. The pocket is larger than the pad, so that the pad may be moved around to the optimum position. The contour of the pad follows the shape of the hand so as to not interfere with movement of the hand or to cause discomfort.

17 Claims, 8 Drawing Figures

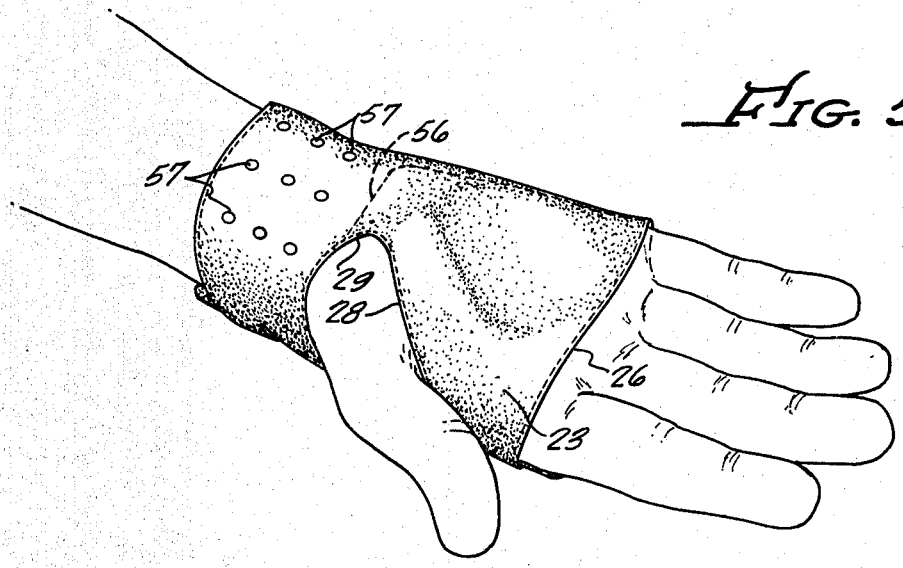
FIG. 5.
FIG. 6.
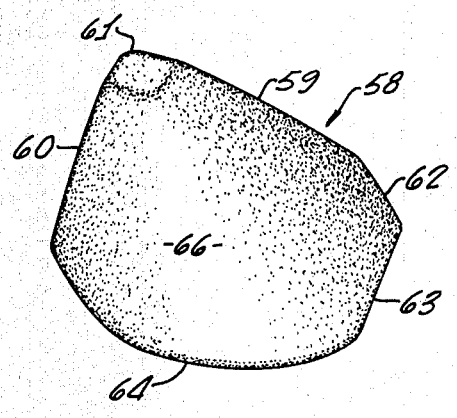
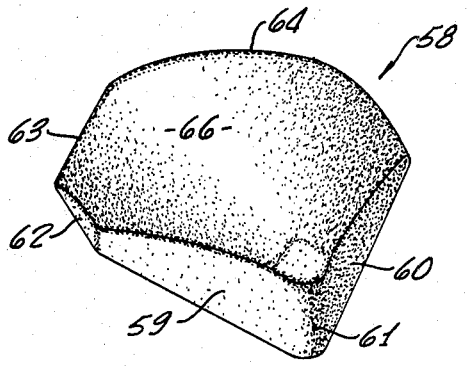
FIG. 7.
FIG. 8.
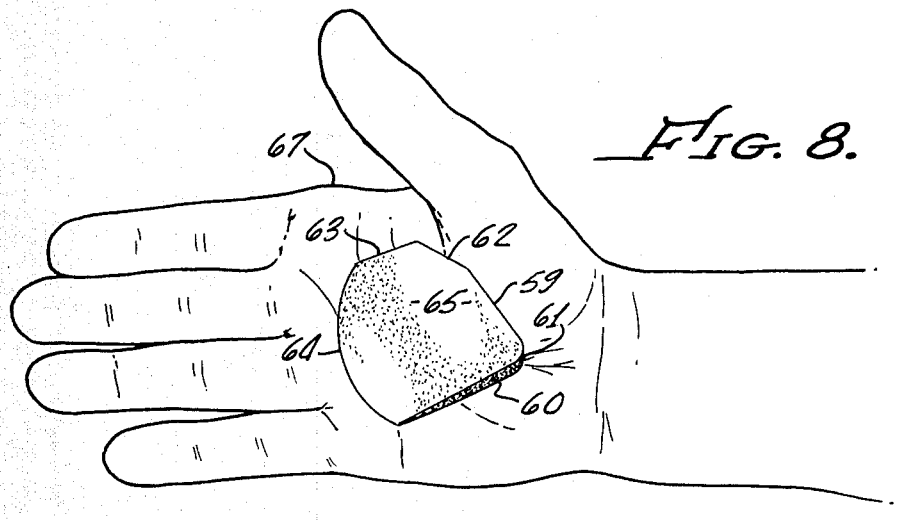

WRIST SUPPORT WITH PALM PAD

BACKGROUND OF THE INVENTION

Many bowlers prefer to wear a wrist support to prevent unwanted movement of the wrist as the ball is swung and released. In order to improve ball control and to obtain greater spin, some bowlers use a wrist support which includes a resilient pad that is positioned at the palm of the hand when the wrist support is worn. The pad is to fill the space between the palm of the hand and the surface of the ball to provide better contact with the ball to lead to better control. An example of such a wrist support is found in U.S. Pat. Nos. 3,031,680 and D. 251,337.

Prior wrist supports with a palm pad have had certain shortcomings, however. One difficulty arises from the fact that the pad is made complementary to the pocket and, therefore, has only one position as the wrist support is worn. Consequently, it is not possible to adjust the position of the pad relative to the main body of the wrist support. This means that the position of the pad is fixed and cannot be adjusted. As a result, the pad may not be positioned correctly for some sizes and shapes of hands, so that it will not properly serve its function of enhancing ball control and may cause the hand to assume an uncomfortable and awkward position.

Another difficulty stems from the shape of the pad which has been used. It has been a generally pie-shaped device, tapering in thickness from a maximum at the center of the curved edge to the point where the straight edges meet. The curved edge is positioned at the heel of the palm as the device is used, with the point up near the juncture of the forefinger and second finger. With the pad being positioned in this manner, it can cause discomfort to the user of the device and hamper movement of the hand, because it does not comply with the shape or points of flexure of the hand.

BRIEF DESCRIPTION OF THE INVENTION

The present invention provides an improved wrist support with a palm pad, overcoming the difficulties with the prior art devices noted above. The flexible body of the device is adapted to wrap around the hand and wrist of the user, with straps holding the wrist support in position. A rigid reinforcement may be included in the portion of the support over the back of the hand and wrist to prevent unwanted movement.

On the portion of the device that fits over the palm, there is a relatively large pocket open at one end. This receives a resilient pad which is of smaller overall lateral dimensions than the pocket. Accordingly, it is possible to move the pad around in the pocket relative to the body. This permits precise positioning of the pad so that the user of the device can be sure that the pad is at the right place on the palm of his hand to fit his own anatomy. The opening to the pocket is concealed by the outer part of the wrist support as it is worn, protecting the pad and improving the appearance of the wrist support.

The pad is shaped so as to have two relatively straight edges meeting at a rounded corner where the pad is the thickest. This part of the pad fits at the base of the heel of the hand, not interfering with movement of the hand while at the same time enabling the pad to take up the space between the hand and the bowling ball. An arcuate edge of the pad, where it has tapered to its minimum dimension, extends from the end of one of the straight edges and is positioned just below the base of the fingers on the palm of the hand when the wrist support is in use. This, again, avoids interference with the movement of the hand at the knuckles. From the other end of the arcuate edge is a short straight edge that is adjacent the side of the hand, which connects to another straight edge which extends near the base of the thumb. By the construction of the pad in this manner, greater comfort and improved control of the bowling ball can be achieved.

BRIEF DESCRIPTION OF THE DRAWINGS

FIG. 5 is a perspective view illustrating the wrist support as it is worn;

FIG. 6 is a perspective view of the pad of the wrist support taken from adjacent one end;

FIG. 7 is a perspective view of the pad of the wrist support taken from the opposite end; and FIG. 8 is a plan view illustrating the relationship of the pad and the wrist support with the hand of the user.

DETAILED DESCRIPTION OF THE PREFERRED EMBODIMENT

Figure 1:
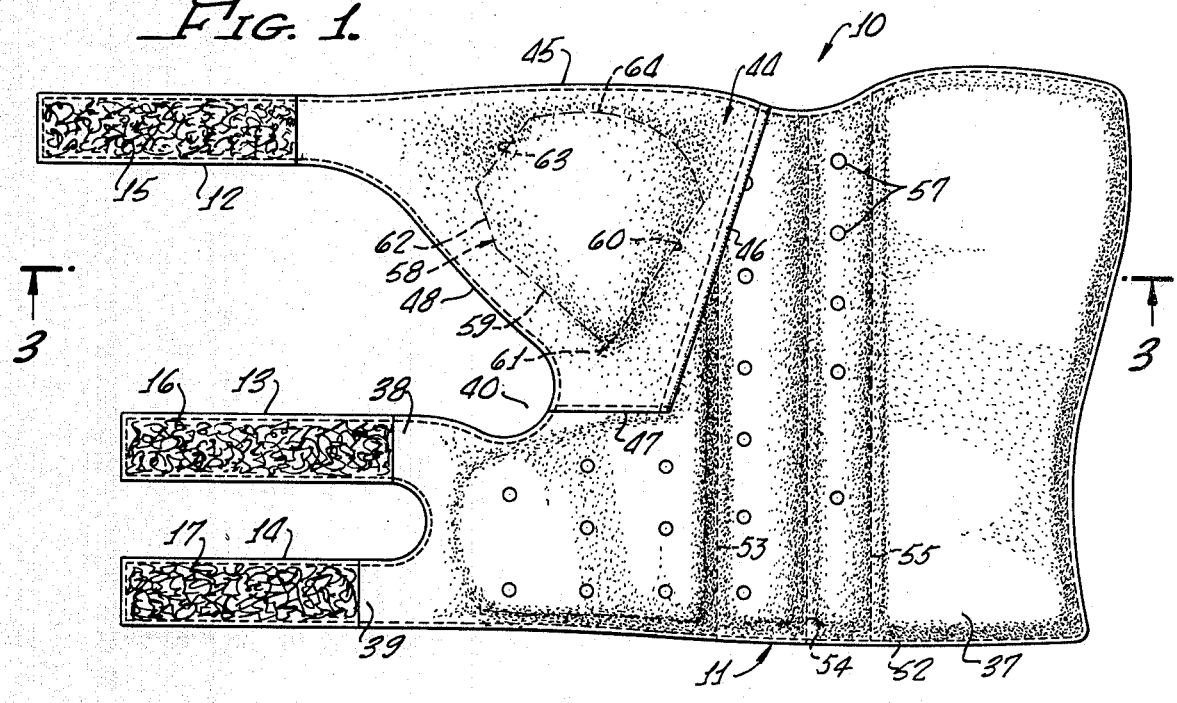
FIG. 1 is an elevational view of one side of the wrist support of this invention in the open position.
Figure 2:
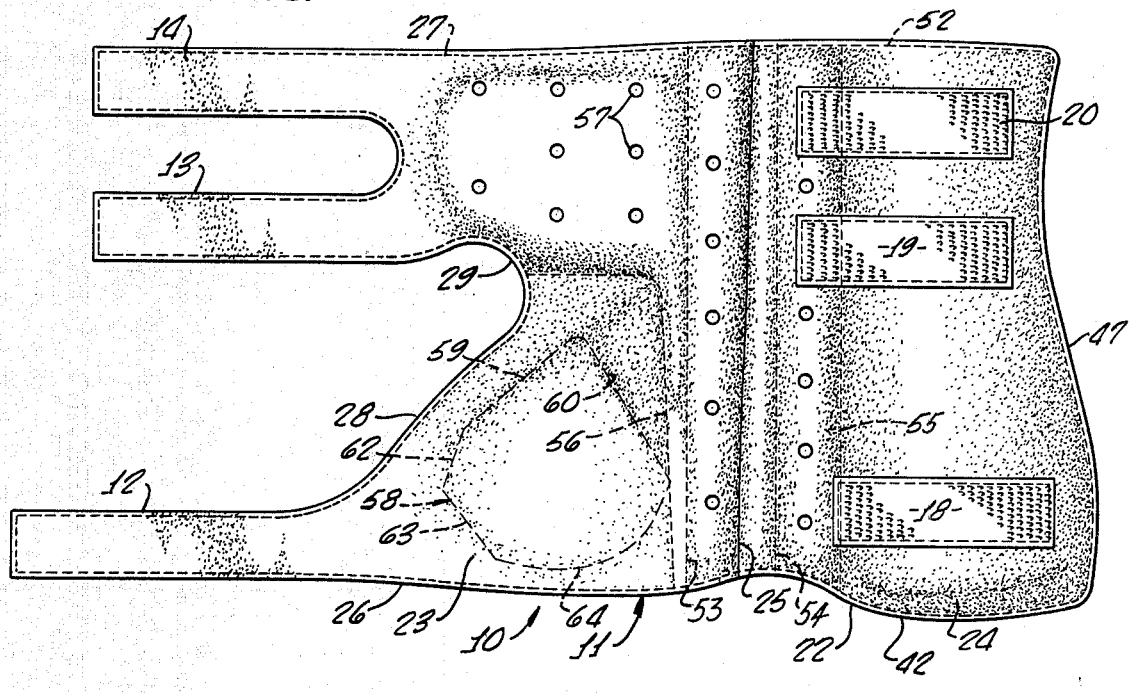
FIG. 2 is a plan view of the other side of the wrist support.
Figure 3:
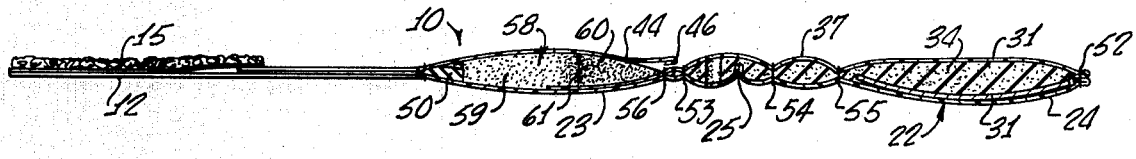
FIG. 3 is a transverse sectional view taken along line 3—3 of FIG. 2.

The wrist support 10 of this invention includes a principal body portion 11, adapted to be wrapped around the hand and wrist of the user, with three straps 12, 13 and 14 at one end which are used in securing the device. The wrist support is secured by a suitable fastening means, such as a hook and pile fastener marketed under the trademark VELCRO. The pile portions 15, 16 and 17 are on the ends of the straps 12, 13 and 14, respectively, on one side of the wrist support, and mate with the hook portions 18, 19 and 20 which are on the other side and adjacent the opposite end of the principal portion 11 of the device.

Figure 4:
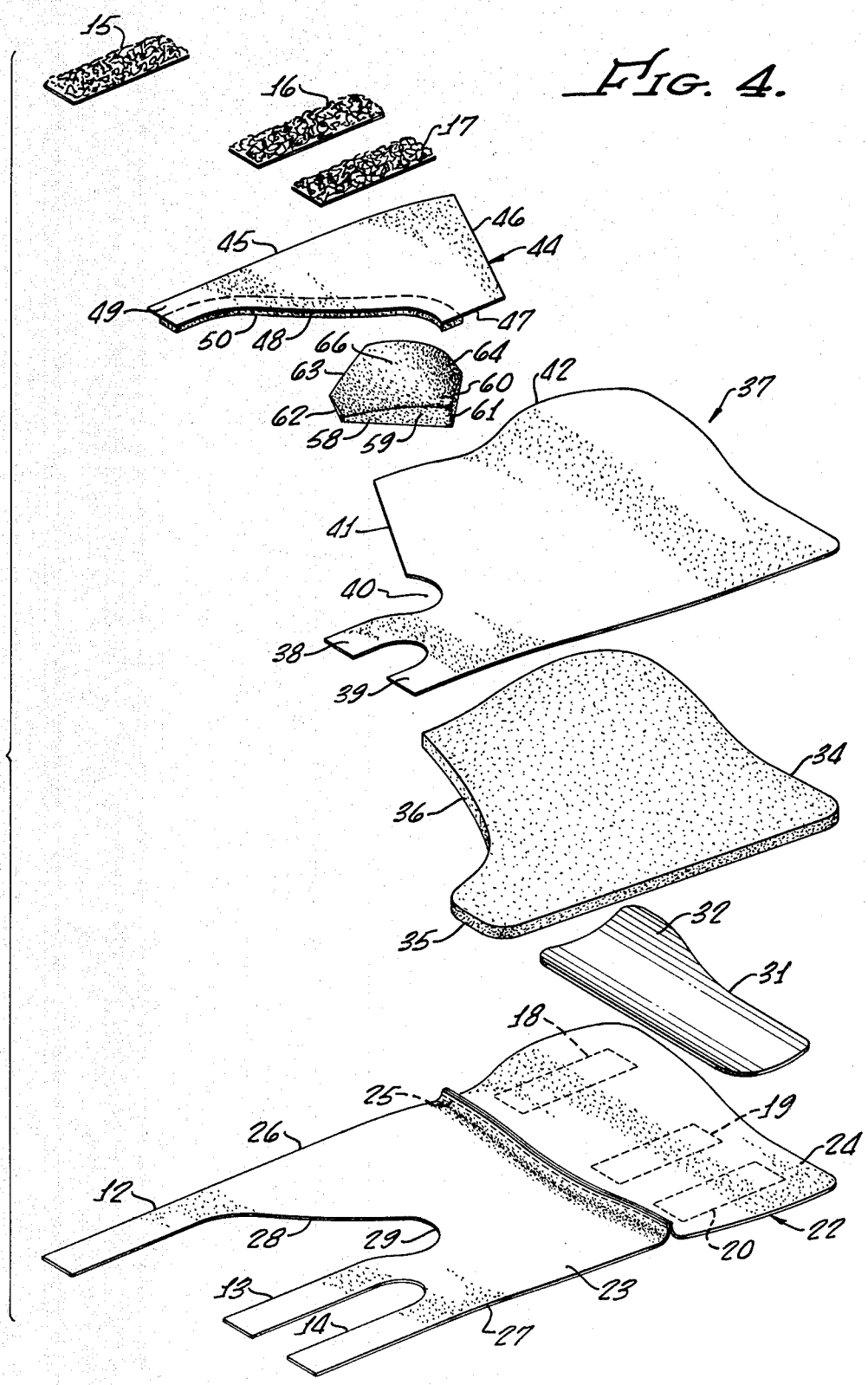
FIG. 4 is an exploded perspective view showing the components of the wrist support.

The components of the wrist support, shown in exploded perspective in FIG. 4, include an outer layer 22 made up of two pieces 23 and 24 of flexible sheet material, such as polyvinylchloride. The two sections 23 and 24 are stitched together at a seam 25 in which the corresponding sides of the two sections are superimposed. Inasmuch as the edges are contoured to be slightly concave, as viewed in FIG. 4, this seam imparts a desired shape to the wrist support when it is completed, helping it conform to the side of the hand and wrist of the user.

Extending from the seam 25, the section 23 includes two elongated more-or-less parallel edges 26 and 27 which continue to form edges of the straps 12 and 14, respectively. An inclined outer edge 28 of the section 23 angles outwardly from a rounded notch 29 near the base of the strap 13 to the strap 12.

Above the section 24 of the layer 22 is a metal reinforcement 31 which serves to keep the wrist relatively rigid when the support is worn. The reinforcement is elongated and wider at one end 32, with a slight concavity about its longitudinal axis, as seen in FIG. 4.

Next is a layer 34 of cushioning material, such as a ¼-inch thick layer of resilient foam plastic. The layer 34 fits over the section 24 of the layer 22, and past the seam 25 to the portion of the section 23 adjacent the seam. An extension 35 on the layer 34 projects over the section 23 to the inner ends of the straps 13 and 14. However, the inclined edge 36 of the layer 34 is recessed inwardly of the extension 35 so that the area of the section 23 between the edges 26 and 28 is free of the cushioning material.

A second outer layer 37 of flexible sheet material, such as fabric reinforced polyvinylchloride, fits over the cushioning layer 34 and, hence, over the section 24 of the other outer layer 22. The layer 37 extends over part of the section 23 of the layer 22, with short projections 38 and 39 that help define the inner ends of the straps 13 and 14. Beyond the extensions 33 and 34, the edge of the layer 37 includes an arcuate recess 40 corresponding to the rounded notch 29 of the section 23. A straight edge 41 completes the end of the layer 37, inclining inwardly from the recess 40 to an arcuate edge 42, which is at the upper portion of the layer 37, as shown in FIG. 4. Therefore, when superimposed on the layer 22, the layer 37 does not cover the space between the edges 26 and 28 of the section 23, although the edge 41 extends beyond the edge 36 of the cushioning material 34.

The area of the section 23 between its edges 26 and 28, and slightly inwardly of that location, is covered by a smaller flexible sheet 44, which may be of the same material as that used for the layers 22 and 37. The sheet 44 includes a relatively long edge 45 which follows the contour of the edge 26 of the section 23. At one end, the edge 45 meets a relatively long straight edge 46 at an acute angle. A short straight edge 47 joins the longer edge 46 at an obtuse angle. The edge 47 is roughly parallel to the edge 45. An inclined edge 48 is arcuate at its end portions so as to be complementary to the edge 28 of the section 23. A short projection 49 at the end of the edges 45 and 48 fits over the inner end of the strap 12 in the completed wrist support. A narrow strip 50 of cushioning material, such as resilient foam plastic, is bonded to the undersurface of the sheet 44 along the edge 48. The sheet 44 is attached to the sheet 23 by stitches that extend along its edges 45, 47 and 48, and at the edge of the projection 49. The edge 46, however, is hemmed, but it is not attached to any other portion of the wrist support. The result is a pocket, open at the straight edge 46, which overlaps the edge 41 of the layer 37 beyond the cushioning layer 34, so that there is no cushioning material at the vicinity of the pocket.

In the assembly, stitches 52 around the periphery secure the layer 37 to the layer 22, with the cushioning material 34 and reinforcement 31 between them. Three additional rows of stitching 53, 54 and 55 extend transversely across the assembly and facilitate the bending and shaping of the wrist support. The latter row of stitching also serves to secure the reinforcing member 31 within the space above the sheet section 24. A generally L-shaped row of stitching 56 confines the edge 36 of the cushioning layer 34. Also, the VELCRO fastenings 15, 16 and 17 are sewn to the straps 12, 13 and 14, and their mating fastenings 18, 19 and 20 are stitched to the undersurface of the section 24 of the sheet 22. Ventilation holes 57 are provided through the assembly.

The pocket defined between the sheet 23 and the overlying smaller sheet member 44 receives a pad 58 of foam plastic material which possesses some resilience. This pad, which is shown enlarged in FIGS. 6 and 7, includes two generally straight edges 59 and 60, which are approximately at right angles to each other, meeting at a rounded corner 61. A relatively short, generally straight edge 62 extends at an obtuse angle from the end of the edge 59 opposite from the corner 61. The edge 62, in turn, connects at an obtuse angle to a straight edge 63, which is longer than the edge 62, but substantially shorter than either of the edge 59 or the edge 60. The outer ends of the edges 59 and 63 are interconnected by an arcuate edge 64, which is not sharply curved. The corner 61 is opposite from the curved edge 64.

The bottom surface 65 of the pad 58, as it is shown in FIGS. 6 and 7, is flat. The top surface 66, however, is slightly domed being convexly rounded.

The pad 58 is tapered in thickness. Its greatest thickness is at the corner 61, from which it tapers to the edges 63 and 64. At the latter locations, the undersurface 65 meets top surface 66. The taper is along the edge 60 and the connected edges 59 and 62, so that these edge portions have a finite thickness. This thickness tapers from the corner 61 along the edge 60 to the juncture of the edge 60 and the edge 64. Similarly, the thickness of the pad becomes progressively less along the edge 59 and the edge 62 to the point where the edge 62 meets the edge 64.

The lateral dimension of the pad 58 is less than the lateral dimension of the pocket that receives it. Hence, the pad 58 can be moved, to a limited extent, within the pocket and, therefore, can assume different positions relative to the remainder of the wrist support. The pad 58 is placed in the pocket with its domed side 66 adjacent the sheet 44. The corner 61 of the pad faces toward the edge 47 of the smaller sheet member 44 which forms the upper portion of the pocket as it appears in FIG. 1. This places the edge 59 of the pad adjacent the edge 48 of the sheet 44 and the edge 60 adjacent the edge 46 at the opening to the pocket. The edges 62 and 63 face toward the inner end of the pocket, and the arcuate edge 64 of the pad is adjacent the edge 45 of the sheet 44.

In use of the wrist support, the sheets 37 and 44 provide the undersurface which engages the hand and wrist of the user. The palm of the hand fits over the sheet 44 with the crotch of the thumb at the inner end of the strap 12, while the laterally adjacent part of the body 10 engages the inside of the wrist. This positions the edge of the wrist support body defined by the edges 26 and 45 of the sheets 23 and 44 at the proximal ends of the fingers.

The area at the seams 53, 54 and 55 provides a second portion of the body of the wrist support which is bent around the side of the hand and the wrist. The third portion of the wrist support, beyond the seam 50 and within which is the reinforcing member 31, is folded over the back of the hand and the wrist. This permits the strap 12 to extend over the back of the hand below the knuckles so that the VELCRO fastening 15 on the strap 12 can mate with the fastening 18 on the sheet member 24. The two closely spaced straps 13 and 14 extend over the back of the wrist so that the fastenings 16 and 17 can mate with the fastenings 19 and 20 on the member 24. As so worn, the rigid reinforcement 31 braces the hand and wrist to prevent backward wrist movement during bowling. The large cushioning pad 34 insures that the device is comfortable to wear and that nothing digs into the hand of the user. Also, the strip of resilient material 50 cushions the edge of the wrist support body that extends from adjacent the proximal end of the index finger over the crotch of the thumb and alongside the base of the thumb to the heel of the palm.

The pad 58, as the wrist support is worn, fills in the space at the palm of the hand where it is slightly cupped by the gripping of the bowling ball. The pad 58, therefore, occupies the space between the palm of the hand and the bowling ball and enhances the control of the ball during bowling. The contour of the pad enables it to do an effective job so that the hand assumes a natural position without interference from the pad.

The relationship between the pad and the hand can be seen in FIG. 8 in which the pad 58 is shown on the palm of the hand in the position it assumes when the wrist support is in place. The rounded edge 64 is located below the fingers approximately at the position where the hand bends at the knuckles, following the natural curvature of the hand. The taper to the edge 64 assures that there is not too much bulk from the pad adjacent the fingers. The short straight edge 63 is positioned generally parallel to the side edge 67 of the hand, and again the smooth taper to this portion of the pad 58 avoids interference to the movement of the hand at this location. The edge 62 angles down at the base of the thumb, and the edge 59 extends along where the hand bends below the thumb to the juncture with the edge 60 at the corner 61. At the latter location, the hand bends to form a V-shaped recess as the bowling ball is gripped, so the pad corresponds to the contour assumed by the hand. Thus, the pad 58 follows the natural configuration of the hand and permits normal hand movement in the act of bowling.

Another advantage arises from the fact that the pad 58 is smaller in lateral dimension than the pocket that receives it. This permits the pad to be shifted around within the pocket, so that the user of the wrist support may select the proper location of the pad to fit his anatomy. Once in this location, the pad does not tend to shift its position, because it is frictionally retained by the walls of the pocket. The opening to the pocket along the edge 46 faces the inside of the pad where the portion of the body 10 at the seams 53, 54 and 55 is bent around the edge of the hand opposite from the thumb, and is completely covered when the wrist support is worn. This facilitates retention of the pad and improves the appearance of the wrist support.

The foregoing detailed description is to be clearly understood as given by way of illustration and example only, the spirit and scope of this invention being limited solely by the appended claims.

I claim:

1. A bowling wrist support comprising a body of flexible sheet material adapted to be wrapped around the hand and wrist, said body having a first portion positionable over the back of the hand and wrist, a second portion positionable over the edge of the hand and wrist, and a third portion positionable over the palm of the hand and the inside of the wrist, means for securing said body in position when so wrapped around a hand and wrist, said third portion of said body defining a pocket positionable generally at the center of the palm of the hand when said body is so wrapped around the hand and wrist, and a pad of resilient material in said pocket, said pad having a lateral dimension sufficiently smaller than that of said pocket to allow said pad to be shifted laterally in said pocket relative to said body for permitting selective locations of said pad relative to the palm of a hand around which said body is so wrapped, said pad tapering in thickness toward at least one edge thereof, said pocket having an opening providing access to said pad for permitting manual movement of said pad to such selective locations.

2. A device as recited in claim 1 in which said pad includes a third edge at an obtuse angle to said second edge of said pad, said third edge projecting from the end of said second edge remote from said corner, and a fourth edge at an obtuse angle from said third edge, said fourth edge interconnecting said third edge and said arucate edge of said pad.

3. A device as recited in claim 2 in which said fourth edge is longer than said third edge of said pad.

4. A bowling wrist support comprising a body of flexible sheet material adapted to be wrapped around the hand and wrist, said body having a first portion positionable over the back of the hand and wrist, a second portion positionable over the edge of the hand and wrist, and a third portion positionable over the palm of the hand and the inside of the wrist, means for securing said body in position when so wrapped around a hand and wrist, said third portion of said body defining a pocket positionable generally at the center of the palm of the hand when said body is so wrapped around the hand and wrist, and a pad of resilient material in said pocket, said pad having two converging edges which meet to define a corner positionable at the heel of the hand, and an arcuate edge substantially opposite from said corner and positionable adjacent the fingers, said pad tapering in thickness from substantially at said corner to said arcuate edge.

5. A device as recited in claim 4 in which said pad includes a relatively short substantially straight edge connecting to one end of said arcuate edge and positionable adjacent the side edge of a hand, said pad tapering in thickness from said corner to said relatively short substantially straight edge.

6. A device as recited in claim 5 in which said pad includes an additional substantially straight edge interconnecting said first mentioned substantially straight edge and one of said two converging edges.

7. A device as recited in claim 6 in which said two converging edges are substantially straight.

8. A device as recited in claim 7 in which said corner is rounded.

9. A device as recited in claim 5 in which said pad includes two principal surfaces, one of which is substantially flat and the other of which is domed.

10. A device as recited in claim 9 in which said two principal surfaces substantially intersect at said arcuate edge and said first mentioned substantially straight edge.

11. A device as recited in claim 4 in which said body includes two outer layers of flexible sheet material, and a layer of resilient cushioning material intermediate said outer layers, said layer of resilient cushioning material being substantially coterminous with said two outer layers at said first and second portions of said body, and extending into said third portion of said body at a location remote from said pocket.

12. A device as recited in claim 4 in which one of said outer layers is coterminous with said third portion of said body, and the other of said outer layers extends over said third portion of said body only to the edge portions of said pocket, said pocket being defined by an additional layer of flexible sheet material extending over the remaining portions of said one outer layer.

13. A device as recited in claim 12 in which said pocket has an opening facing said second portion of said body and in juxtaposition with the intersection of said second and third portions of said body.

14. A device as recited in claim 4 in which said body at said third portion includes a first outer edge adapted to extend across the palm of a hand adjacent the proximal ends of the fingers, and a second outer edge at an acute angle to said first outer edge adapted to extend across the palm of a hand from adjacent the proximal end of the index finger to the heel of the hand, said pocket extending substantially to said first and second outer edges.

15. A device as recited in claim 14 in which said means for securing said body in position includes strap means, and one of said strap means projects from and forms a continuation of said first and second outer edges.

16. A device as recited in claim 15 in which said body includes a strip of resilient material extending along said second outer edge.

17. A bowling wrist support comprising a body of flexible sheet material adapted to be wrapped around the hand and wrist, said body having a first portion positionable over the back of the hand and wrist, a second portion positionable over the edge of the hand and wrist, and a third portion positionable over the palm of the hand and the inside of the wrist, means for securing said body in position when so wrapped around a hand and wrist, said third portion of said body defining a pocket positionable generally at the center of the palm of the hand when said body is so wrapped around the hand and wrist, and a pad of resilient material in said pocket, said pad having a smaller lateral dimension than that of said pocket, whereby said pad can be shifted laterally in said pocket relative to said body for permitting selective locations of said pad relative to the palm of a hand around which said body is so wrapped, said body at said pocket including a first edge adapted to extend across the palm of a hand adjacent the base of the fingers, a second edge at an acute angle to said first edge adapted to extend across the palm of a hand adjacent the base of the thumb, and a third edge defining an opening to said pocket at an acute angle to said second edge and adapted to extend alongside the edge of the hand remote from the thumb, said pad having an arcuate edge adjacent said first edge of said body, a first generally straight edge adjacent said second edge of said body, and a second generally straight edge adjacent said third edge of said body, said second and third edges of said pad meeting at a corner, said pad tapering in thickness from adjacent said corner to said arcuate edge.

* * * * *